US008028795B2

(12) United States Patent
Hisanaga et al.

(10) Patent No.: US 8,028,795 B2
(45) Date of Patent: Oct. 4, 2011

(54) EXHAUST COMPONENT COVER

(75) Inventors: Toru Hisanaga, Hamamatsu (JP); Akihiro Kawamata, Hamamatsu (JP); Tomoyuki Uchida, Hamamatsu (JP); Shingo Oshimizu, Hamamatsu (JP)

(73) Assignee: Yutaka Giken Co., Ltd., Hamamatsu-shi (JP)

( * ) Notice: Subject to any disclaimer, the term of this patent is extended or adjusted under 35 U.S.C. 154(b) by 0 days.

(21) Appl. No.: 12/616,963

(22) Filed: Nov. 12, 2009

(65) Prior Publication Data

US 2010/0122682 A1 May 20, 2010

(30) Foreign Application Priority Data

Nov. 19, 2008 (JP) ..... 2008-295880
Nov. 19, 2008 (JP) ..... 2008-295892

(51) Int. Cl.
*F02B 77/11* (2006.01)

(52) U.S. Cl. ..... 181/205; 181/204; 181/282

(58) Field of Classification Search ..... 181/204, 181/205, 210, 211, 241, 282
See application file for complete search history.

(56) References Cited

U.S. PATENT DOCUMENTS

| | | | | | |
|---|---|---|---|---|---|
| 2,978,566 | A * | 4/1961 | Batson | | 219/270 |
| 3,141,518 | A | 7/1964 | Heath | | |
| 4,164,989 | A * | 8/1979 | Lux et al. | | 181/265 |
| 4,609,067 | A * | 9/1986 | Gonwa | | 181/211 |
| 4,890,690 | A * | 1/1990 | Fischer et al. | | 181/240 |
| 4,894,987 | A * | 1/1990 | Harwood et al. | | 60/299 |
| 5,036,947 | A * | 8/1991 | Metzger | | 181/241 |
| 5,196,253 | A * | 3/1993 | Mueller et al. | | 428/138 |
| 5,281,778 | A * | 1/1994 | Cheladyn et al. | | 181/241 |
| 5,680,757 | A * | 10/1997 | Pirchl | | 60/299 |
| 5,779,539 | A * | 7/1998 | Kolt | | 454/368 |
| 5,890,532 | A * | 4/1999 | Kim et al. | | 165/151 |
| 5,975,199 | A * | 11/1999 | Park et al. | | 165/151 |
| 6,302,466 | B1 * | 10/2001 | Zwick | | 296/39.3 |
| 6,451,447 | B1 * | 9/2002 | Ragland et al. | | 428/593 |
| 2006/0124387 | A1 * | 6/2006 | Berbner et al. | | 181/290 |
| 2008/0245604 | A1 * | 10/2008 | Saunders et al. | | 181/227 |
| 2008/0251314 | A1 * | 10/2008 | Mizutani | | 181/251 |

FOREIGN PATENT DOCUMENTS

| | | |
|---|---|---|
| JP | 59041618 | 3/1984 |
| JP | 02298621 | 12/1990 |
| JP | 2000-136720 | 5/2000 |
| JP | 2002-087078 | 3/2002 |
| WO | 9939087 | 8/1999 |

* cited by examiner

*Primary Examiner* — Jeremy Luks
(74) *Attorney, Agent, or Firm* — Rankin, Hill & Clark LLP

(57) ABSTRACT

A lightweight exhaust component cover having a small number of components is disclosed. In the exhaust component cover, an internal plate is formed by bending part of a single plate at both ends, and the internal plate is joined to the inside surface of an external plate.

11 Claims, 9 Drawing Sheets

FIG.8
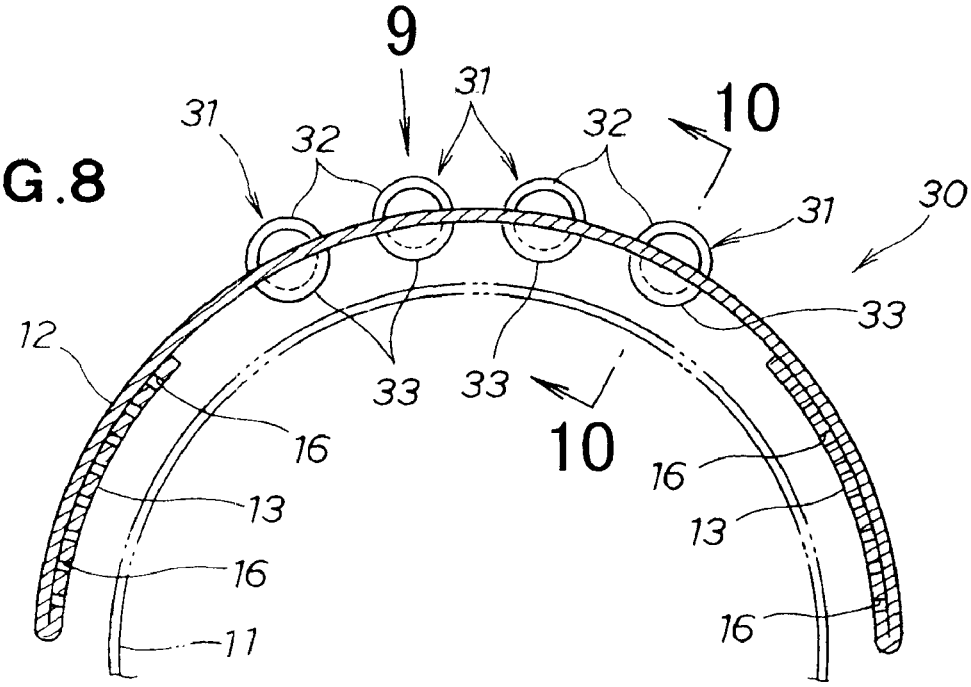
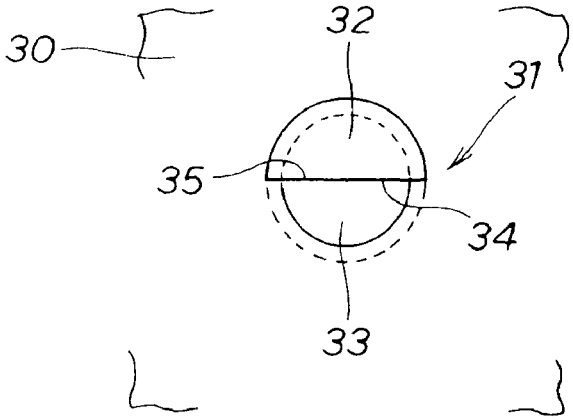
FIG.9
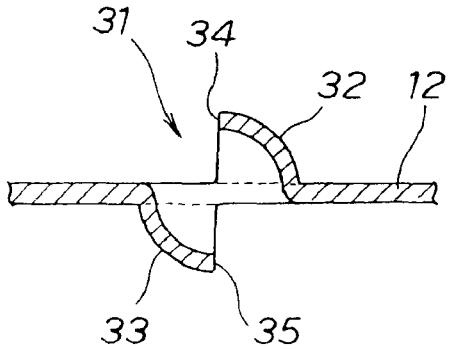
FIG.10

(CONV.EX.1)

(CONV.EX.2)

(3RD EMB.)

(3RD EMB.)

EXHAUST COMPONENT COVER

FIELD OF THE INVENTION

The present invention relates to an exhaust component cover for covering an exhaust component.

BACKGROUND OF THE INVENTION

Mufflers, for example, and other exhaust components extending from an engine include exhaust component covers referred to as noise and heat insulation covers installed particularly in regions prone to sound and heat, such as is disclosed in Japanese Patent Application Laid-Open Publication No. 2002-87078 (JP 2002-087078 A), for example. The exhaust component cover disclosed in JP 2002-87078 A is shown in FIG. 14 hereof.

Referring to FIG. 14, an exhaust component cover 100 is manufactured by joining an internal plate 103 to an external plate 101 via aluminum foil 102, bending one end of the external plate 101 in the direction of the internal plate 103, and then integrally press-forming the external plate 101, the aluminum foil 102, and the internal plate 103 together.

The exhaust component cover 100 manufactured in this manner covers regions of the exhaust component prone to sounds, and muffles noise produced by the exhaust component.

While the engine is operating, the vibration of the engine is transmitted to the exhaust component, and the vibration is further transmitted to the exhaust component cover. This vibration causes self-excited vibration in the exhaust component cover, and also causes so-called radiant noise.

The natural frequency fn of the exhaust component cover 100 is expressed by the equation $fn=1/(2\pi)\times(k/m)^{0.5}$. The letter k denotes a spring constant whose numerical value differs depending on the material, and the letter m denotes mass.

When the external plate 101 and the internal plate 103 have different thicknesses, the external plate 101 and the internal plate 103 also have different masses in; therefore, the external plate 101 and the internal plate 103 will have different natural frequencies fn, and the vibration can be damped.

However, in order to damp the vibration of the exhaust component cover 100 described above, an external plate 101 and an internal plate 103 of different thicknesses must be prepared, increasing both the weight and number of components.

SUMMARY OF THE INVENTION

It is therefore an object of the present invention to provide a lightweight exhaust component cover that can be manufactured with a small number of components.

According to one aspect of the present invention, there is provided an exhaust component cover comprising an external plate designed so as to cover an exhaust component, and an internal plate formed by bending part of the external plate, the internal plate being joined to the inside surface of the external plate.

Thus, in the present invention, only a single plate need be prepared because the internal plate is formed by bending part of the external plate. Specifically, the number of components can be reduced and material costs can be curtailed because there is no need to prepare two plates of different thicknesses. Furthermore, since the internal plate is formed by bending the two ends of the external plate, a space can be created between two halves of the internal plate. In other words, there is no need to join the internal plate to the entire inside surface of the external plate. Therefore, the weight of the exhaust component cover can be reduced. Furthermore, forming the internal plate by bending part of the external plate causes only the external plate to be visible from the outside. The outward appearance of the exhaust component cover is improved by forming the external plate from a single plate.

It is preferred that a plurality of punched holes be formed in the internal plate. Therefore, the weight of the internal plate can be reduced, and the exhaust component cover can be further reduced in weight.

It is preferred that the external plate have a plurality of louvers formed so as to allow air to flow from the outside of the external plate to the inside, and that each of the louvers have a semicircular shape when the exhaust component cover is viewed from the outside, the semicircles each being one fourth of a spherical shell extending outward from the exhaust component cover. Radiant heat that extends in a straight line from the exhaust component to the exhaust component cover is blocked by the exhaust component cover. However, communicating the outside of the exhaust component cover with the inside via the louvers allows convection current to be created from the outside of the exhaust component cover to the inside. Heat can be radiated to the outside by this convection current. Therefore, heat is not readily confined between the exhaust component and the exhaust component cover, and the temperature of the exhaust component cover can be reduced.

It is preferred that the external plate have a plurality of louvers formed so as to allow air to flow from the outside of the external plate to the inside, and that each of the louvers have a circular shape obtained by combining two semicircles when the exhaust component cover is viewed from the outside, one semicircle being one fourth of a spherical shell extending outward from the exhaust component cover, and the other semicircle being one fourth of a spherical shell recessed toward the exhaust component. Therefore, the amount of air taken in from the exterior of the exhaust component cover can be increased, and the cooling performance of the exhaust component can be further improved.

According to another aspect of the present invention, there is provided an exhaust component cover comprising an internal plate designed so as to cover an exhaust component, and an external plate formed by bending part of the internal plate, the external plate being joined to the outside surface of the internal plate.

Thus, in the exhaust component cover according to the other aspect, only a single plate need be prepared because the external plate is formed by bending part of the internal plate. Specifically, the number of components can be reduced and material costs can be curtailed because there is no need to prepare two plates of different thicknesses. Furthermore, since the external plate is formed by bending the two ends of the internal plate, a space can be created between two halves of the external plate. In other words, there is no need to join the external plate to the entire outside surface of the internal plate. Therefore, the weight of the exhaust component cover can be reduced. Furthermore, forming the external plate by bending the two ends of the internal plate causes the internal peripheral surface of the internal plate to lie within a single plane. Therefore, the size of the exhaust component cover can be made closer to the size of the exhaust component, and the exhaust component cover can be made more compact.

It is preferred that a plurality of punched holes be formed in the external plate. Therefore, the external plate can be made more lightweight, and the weight of the exhaust component cover can be further reduced.

In a preferred form, the internal plate has a plurality of louvers formed to allow air to flow from outside of the internal plate to inside of the latter. Each of the louvers may have a semicircular shape when the exhaust component cover is viewed from the outside. The semicircles each may be one fourth of a spherical shell extending outwardly from the exhaust component cover.

In a desired form, the internal plate has a plurality of louvers formed to allow air to flow from outside of the internal plate to inside of the latter. Each of the louvers may have a circular shape obtained by combining two semicircles when the exhaust component cover is viewed from the outside. One semicircle may be one fourth of a spherical shell extending outwardly from the exhaust component cover while the other semicircle may be one fourth of a spherical shell recessed toward the exhaust component.

BRIEF DESCRIPTION OF THE DRAWINGS

Certain preferred embodiments of the present invention will be described in detail below, by way of example only, with reference to the accompanying drawings, in which:

FIG. 8 is a cross-sectional view showing the exhaust component cover according to the third embodiment shown in FIG. 7;

FIG. 9 is a view showing a louver as seen in the direction of arrow 9 of FIG. 8;

FIG. 10 is a cross-sectional view taken along line 10-10 of FIG. 8;

DETAILED DESCRIPTION OF THE PREFERRED EMBODIMENTS

Reference is now made to FIGS. 1 through 4 showing an exhaust component cover according to the first embodiment of the present invention.

Figure 1:
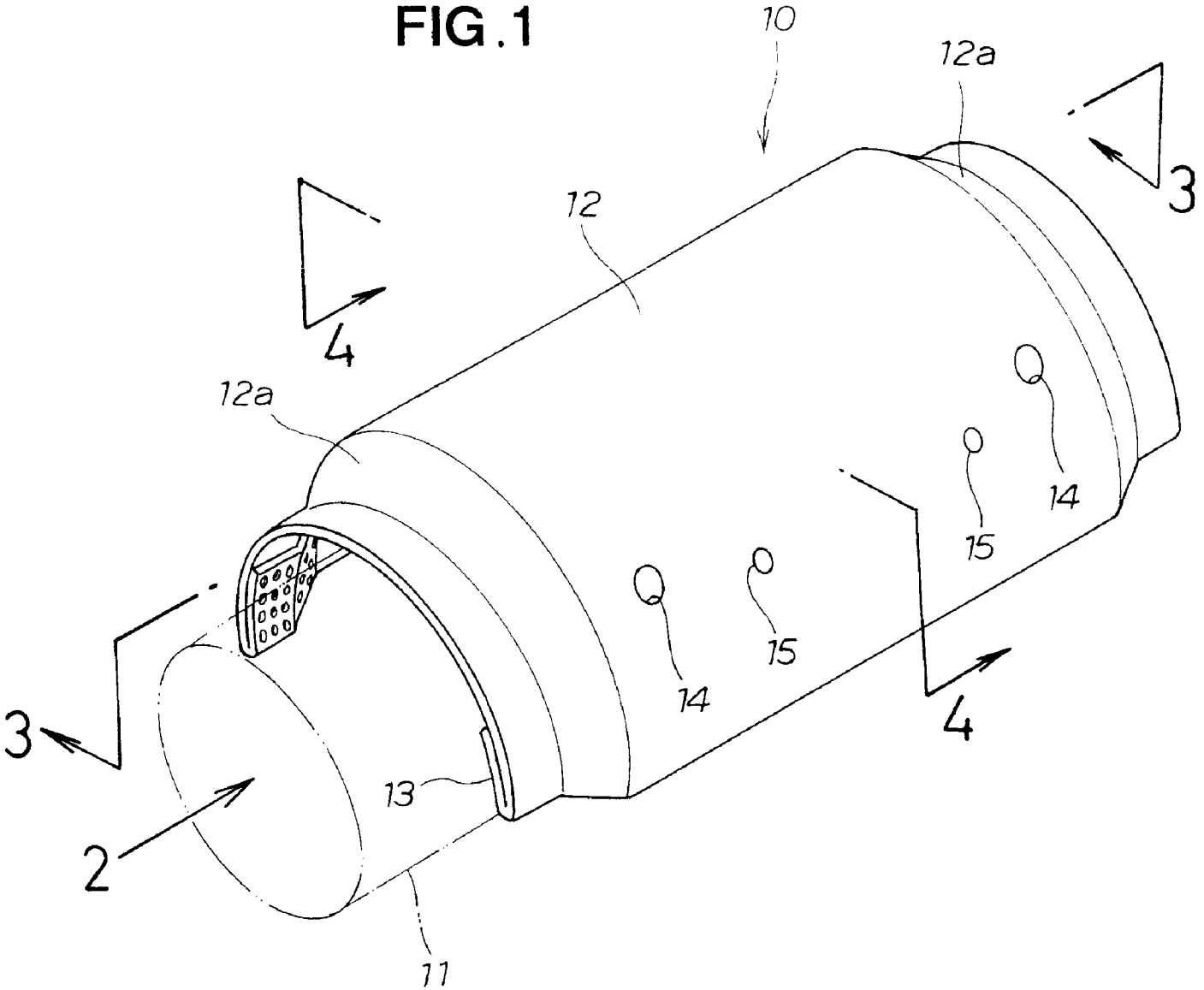
FIG. 1 is a perspective view showing an exhaust component cover according to a first embodiment of the present invention.

As shown in FIG. 1, an exhaust component cover 10 is comprised of an external plate 12 for covering an exhaust component 11 shown by imaginary lines, an internal plate 13 formed by bending part of the external plate 12, and a plurality of bolt holes 14, 14 formed through the external plate 12 and the internal plate 13 in order to attach the exhaust component cover 10 to the exhaust component 11. In addition to an automotive muffler or catalyzer, another possible example of the exhaust component 11 is a common exhaust tube.

The reference numerals 15, 15 denote weld marks formed when the internal plate 13 is spot welded to the external plate 12.

Welding, crimping, riveting, bolting, screwing, or any other desired method can be used to join the internal plate 13 to the external plate 12, and the joining method is not limited to spot welding.

Forming the internal plate 13 by bending part of the external plate 12 allows only the external plate 12 to be outwardly visible. Forming the external plate 12 from a single plate allows the exhaust component cover 10 to have a satisfactory outward appearance.

Figure 2:
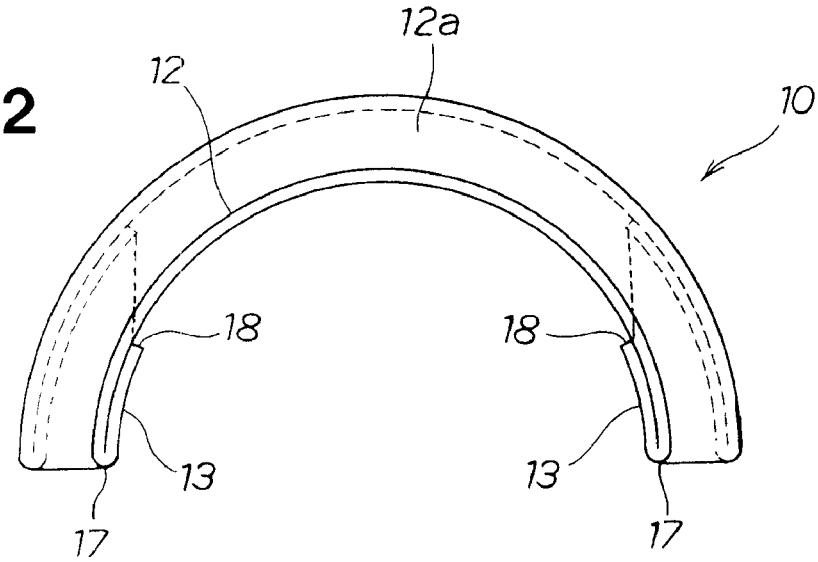
FIG. 2 is a view of the exhaust component as seen in the direction of arrow 2 of FIG. 1.

Two halves of the internal plate 13, 13 are formed by bending part of the external plate 12 so that the two halves are joined to the inside surface of the external plate 12, as shown in FIG. 2. Since the internal plate 13 is formed by bending part of the external plate 12 in this manner, the exhaust component cover 10 can be manufactured from a single plate. The portions where the external plate 12 is bent constitute end parts 17, 17 of the exhaust component cover 10. Specifically, high strength can be obtained because the end parts 17, 17 are formed by bending.

Forming the two halves of the internal plate 13, 13 by bending part of the external plate 12 allows the edge portions 18, 18 of the external plate 12 to be folded inward. Since the edge portions 18, 18, which are textured by trimming, are folded inward, the portions exposed to the exterior (i.e., the end parts 17 and the external plate 12) can be made flat. Flattening the exposed portions and folding the textured portions inward increases the safety of the operation for attaching the exhaust component cover 10.

Figure 3:
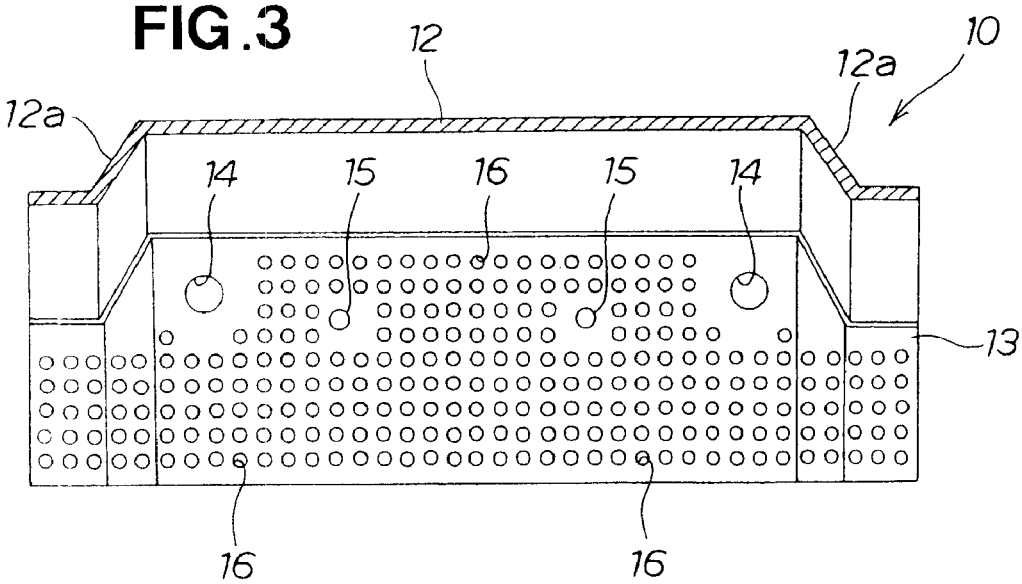
FIG. 3 is a cross-sectional view taken along line 3-3 of FIG. 1.

A plurality of punched holes 16 is formed in the internal plate 13, and tapered parts 12*a*, 12*a* formed by drawing are provided to the front and rear ends, as shown in FIG. 3. Since the punched holes 16 are formed in the internal plate 13, the mass of the internal plate can be reduced. The weight of the exhaust component cover 10 can be reduced by reducing the mass of the internal plate 13.

The bolt holes 14, 14 are formed through the external plate 12 and the internal plate 13. Specifically, the bolt holes 14, 14 are formed in the portions where the internal plate 13 is positioned. The accumulation of stress from forming the bolt holes 14 can be minimized and strength can be ensured to a greater degree than in a case of opening holes in portions of the external plate 12 alone. The joining strength between the external plate 12 and the internal plate 13 can be increased by providing the bolt holes 14 to the portions where the internal plate 13 is positioned.

Moreover, the internal plate 13 is folded onto the external plate 12 to provide a two-ply construction and fastened to the exhaust component 11. Owing to this arrangement, engine vibrations transmitted to the exhaust component 11, even inputted into the two-ply part forming the internal plate 13, can hardly be transmitted to the single-ply external plate 12 because there is produced a large difference in rigidity between the two-ply part and the single-ply part of the external plate 12.

Since the bolt holes 14 are formed through the external plate 12 and the internal plate 13, there is no need to provide separate flanges or the like when attaching the exhaust component cover 10 to the exhaust component 11 (FIG. 1). Since there is no need to provide flanges or the like, the exhaust component cover 10 can be made more compact.

Figure 4:
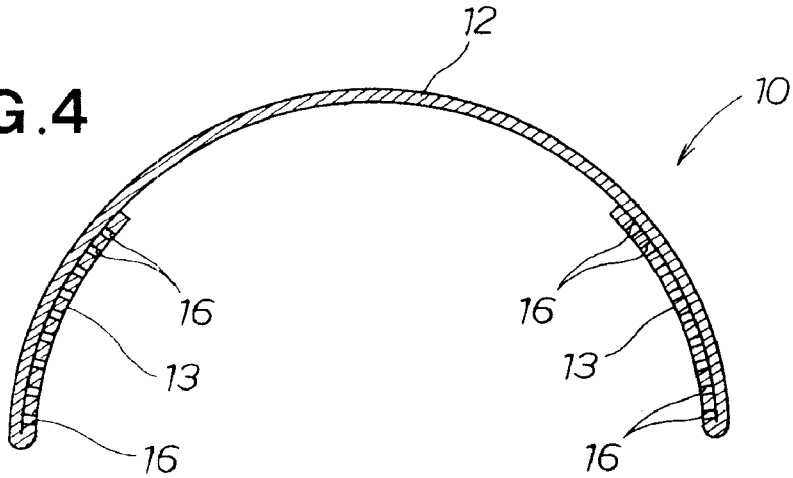
FIG. 4 is a cross-sectional view taken along line 4-4 of FIG. 1.

The natural frequency fn related to the vibration of the exhaust component cover 10 is expressed by the equation $fn=1/(2\pi)\times(k/m)^{0.5}$, as shown in FIG. 4. The letter k denotes a spring constant, whose numerical value differs depending on the material, and the letter m denotes mass.

Since the punched holes 16 are formed in the two halves of the internal plate 13, 13, the internal plate 13 is lighter than the external plate 12 by an amount proportionate to the punched holes 16. Since the internal plate 13 is formed by bending part of the external plate 12, the spring constant k is the same value for both the internal plate 13 and the external plate 12. Since the mass m differs between the external plate 12 and the internal plate 13 as described above, the natural frequency fn differs between the external plate and the internal plate, and the vibration characteristics can be improved.

Since the internal plate 13 is formed by bending the two ends of the external plate 12, a space between two halves of the internal plate 13, 13 can be formed. Specifically, there is no need to join the internal plate 13 to the entire inside surface of the external plate 12. The weight of the exhaust component cover 10 can be reduced by not joining the internal plate 13 to the entire inside surface of the external plate 12. This type of method for manufacturing an exhaust component cover is described based on FIGS. 5A through 5C.

Figure 5A:
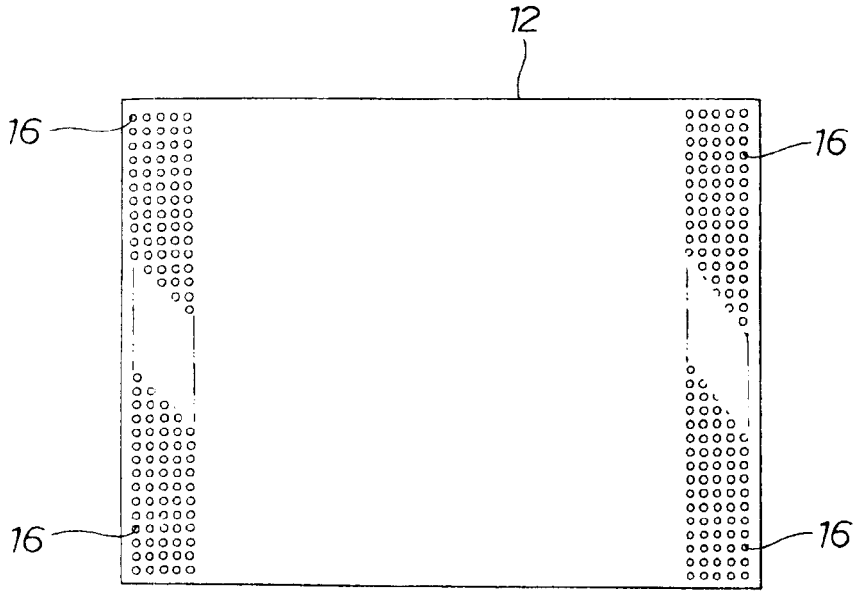
FIGS. 5A through 5C are schematic views illustrating a method for manufacturing the exhaust component cover of FIG. 1.

In the external plate 12, the punched holes 16 are formed by punching the portions that will be bent and become the internal plate, as shown in FIG. 5A.

Figure 5B:
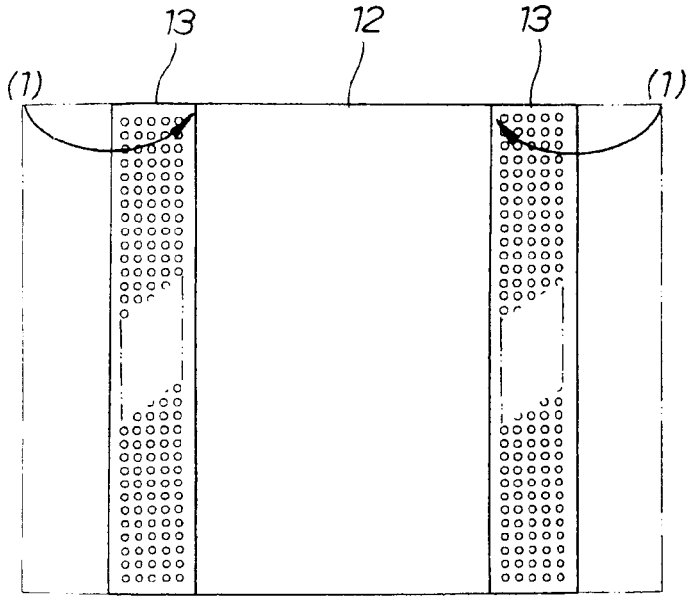
Figure 5C:
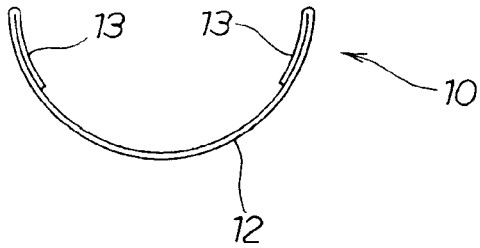

Next, the portions where the punched holes 16 are formed are bent inward as shown by the arrows (1) in FIG. 5B, and the internal plate 13 is formed. The plate in which the internal plate 13 is formed is press-formed as shown in FIG. 5C, manufacturing the exhaust component cover 10.

Any desired shape can be obtained by the subsequent application of drawing as necessary. Forming the bolt holes 14 (FIG. 1) and joining the internal plate 13 and the external plate 12 together can be performed with the desired timing after the internal plate 13 is formed.

Figure 6A:
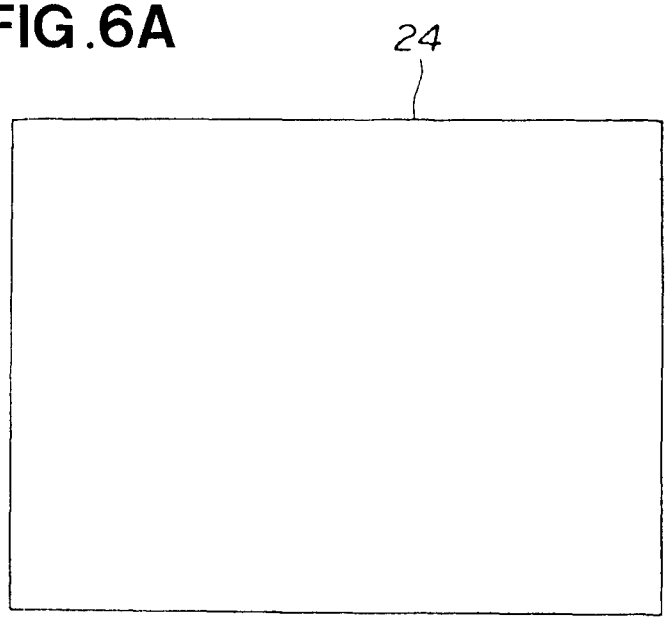
FIGS. 6A through 6C are schematic views illustrating a method for manufacturing an exhaust component cover according to a second embodiment of the present invention.
Figure 6B:
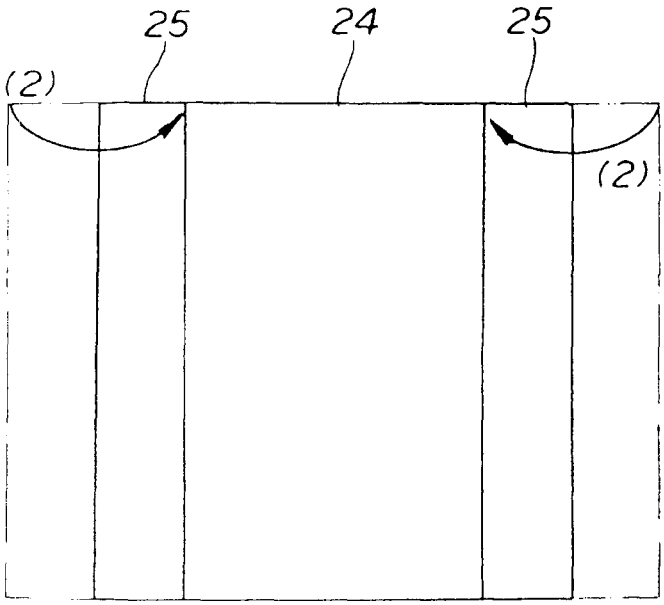
Figure 6C:
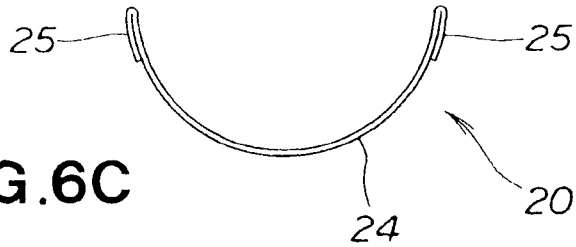

In the exhaust component cover 10 according to the first embodiment, an example was described in which a plurality of punched holes was formed, but the present invention is not limited to this option alone, and another option is an exhaust component cover in which a plurality of punched holes 16 has not been formed. FIGS. 6A through 6C show a method for manufacturing an exhaust component cover according to a second embodiment.

First, a plate that will become an internal plate 24 is prepared as shown in FIG. 6A.

Next, the two ends of the internal plate 24 are bent as shown by the arrows (2) in FIG. 6B, and an external plate 25 is formed.

The plate in which the external plate 25 is formed is press-formed into a cross-sectional arcuate shape as shown in FIG. 6C, and an exhaust component cover 20 is manufactured.

Thus, the internal peripheral surface of the internal plate 24 becomes what is referred to as flush by bending the two ends of the internal plate 24 to form the external plate 25. A flush internal peripheral surface of the internal plate 24 makes it possible for the size of the exhaust component cover 20 to be nearer to the size of the exhaust component. The exhaust component cover 20 can thereby be made more compact.

In the second embodiment, an example of an exhaust component cover was described in which a plurality of punched holes was not formed, but the present invention is not limited to this option alone, and the external plate may be formed by bending the two ends of the internal plate in addition to forming a plurality of punched holes.

Figure 7:
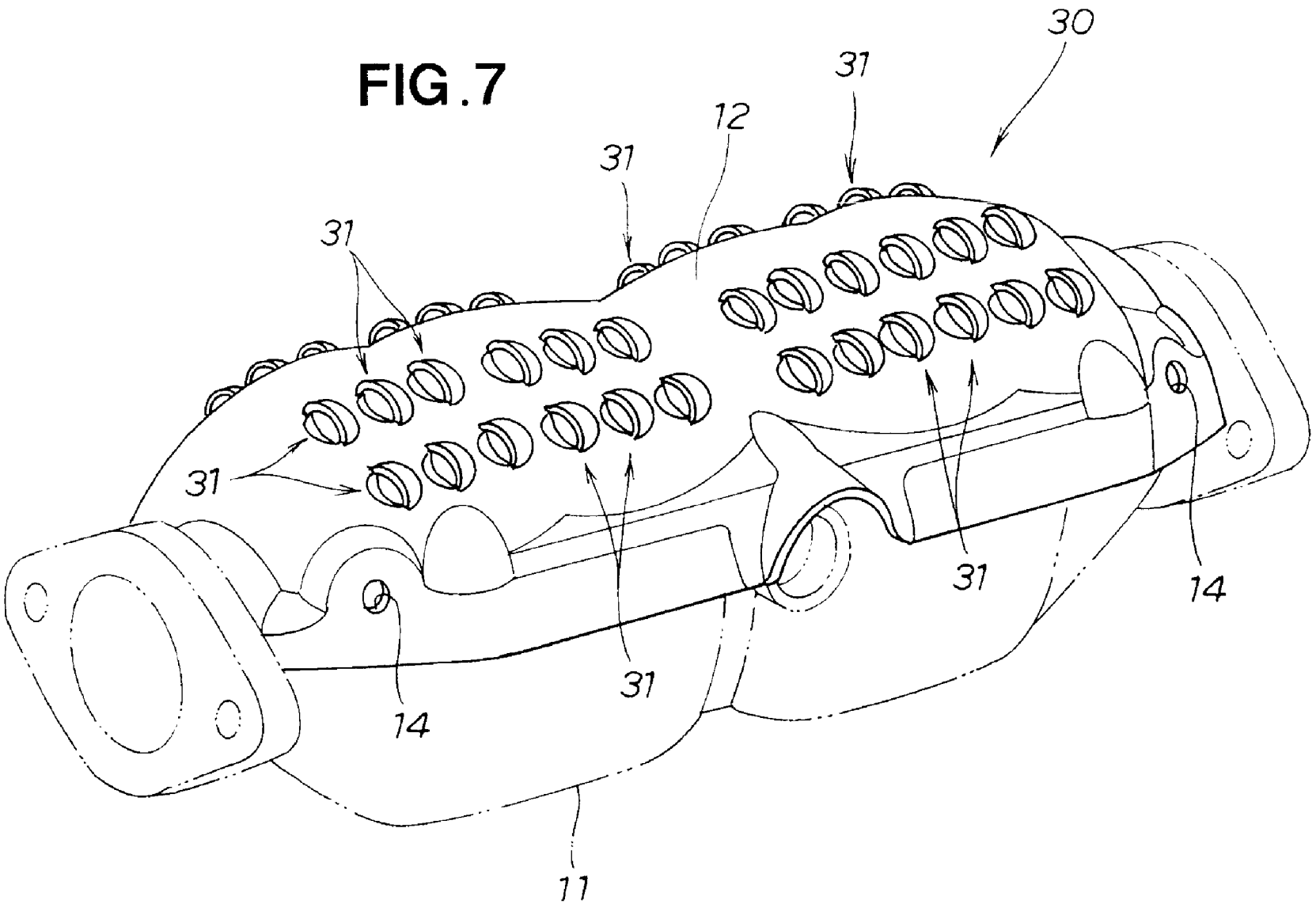
FIG. 7 is a perspective view showing an exhaust component cover according to a third embodiment of the present invention.

FIGS. 7 and 8 show an exhaust component cover 30 according to the third embodiment. In the description of the exhaust component cover 30 according to the third embodiment, members similar to those of the exhaust component cover 10 presented in the first embodiment are described using the same numerical symbols.

Referring to FIGS. 7 and 8, the exhaust component cover 30 according to the third embodiment is disposed so as to cover the exhaust component 11 shown by the imaginary lines. Specific examples of the exhaust component 11 would be the same as the components suggested in the description of the first embodiment.

The exhaust component cover 30 is attached to the exhaust component 11 by fitting bolts through the bolt holes 14, 14 formed in the exhaust component cover 30 via stays or the like (not shown) mounted on the exhaust component 11.

The exhaust component cover 30 has an external plate 12, two halves of the internal plate 13, 13 formed by bending part of the external plate 12 so as to join the halves to the internal sides of the external plate 12, and a plurality of louvers 31 formed on the top surface of the external plate 12, as shown in FIG. 8. The exhaust component 11 is exposed to the exterior via the louvers 31.

The two halves of the internal plate 13, 13 have a plurality of punched holes 16. These punched holes 16 are formed in advance in the portions of the external plate 12 that will be bent to form the two halves of the internal plate 13, 13.

When the pulsation of exhaust gas is transmitted to the exhaust component 11 in the form of vibration, the vibration is further transmitted to the exhaust component cover 30. At this time, the natural frequency fn of vibration of the exhaust component cover 30 is expressed by the equation $fn=1/(2\pi)\times(k/m)^{0.5}$. The letter k denotes a spring constant whose numerical value differs depending on the material, and the letter m denotes mass.

Since the two halves of the internal plate 13, 13 are the same material as the external plate 12, the spring constant k is the same value as in the external plate 12. Since the mass m differs between the external plate 12 and the two halves of the internal plate 13, 13 by an amount proportionate to the punched holes 16 formed in the two halves of the internal plate 13, 13, the natural frequency fn differs between the external plate 12 and the two halves of the internal plate 13, 13, and the vibration characteristics can be improved.

Furthermore, the rigidity of the exhaust component cover 30 is increased by forming the louvers 31 into semicircular shapes.

The louvers 31 have top and bottom semicircular portions whose border is the external plate 12, and the louvers are circular as a whole, as shown in FIGS. 9 and 10. The top semicircular portions are convex parts 32 extending upward, and the bottom semicircular portions are concave parts 33 recessed downward. Each convex part 32 is a fourth of a spherical shell extending outward from the exhaust the external plate 12 (upward), and each concave part 33 is a fourth of a spherical shell recessed toward the exhaust component 11 (FIG. 8) disposed on the inside of the external plate 12 (downward). Distal ends 34 of the convex parts 32 and distal ends 35 of the concave parts 33 lie along vertical straight lines.

Figure 11A:
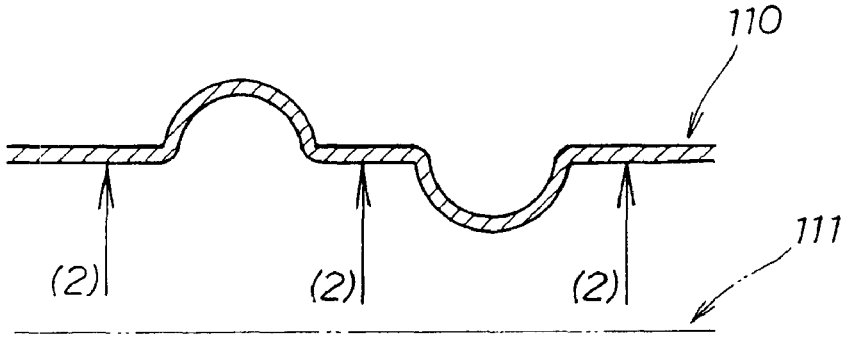
FIGS. 11A through 11D are schematic views showing the exhaust component cover according to the third embodiment of the present invention, as compared to conventional exhaust component covers.
Figure 11B:
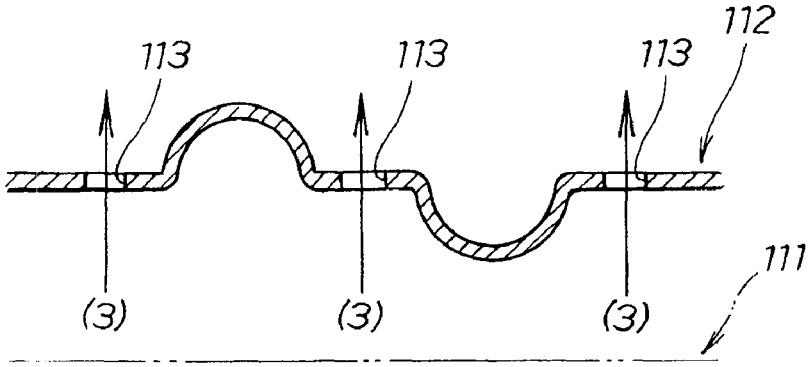

Next, the operation of the exhaust component cover 30 according to the third embodiment will be described based on FIGS. 11A through 11D, using conventional examples for the sake of comparison. FIGS. 11A and 11B show conventional examples, and FIGS. 11C and 11D show the exhaust component cover according to the third embodiment.

In Conventional Example 1, an exhaust component cover 110 does not have holes for radiation; therefore, radiant heat from an exhaust component 111 is blocked as shown by the arrows (2), and heat is confined between the exhaust component 111 and the exhaust component cover 110.

In Conventional Example 2, in which a plurality of holes 113 is formed in an exhaust component cover 112 as shown in FIG. 11B, radiant heat from the exhaust component 111 is radiated to the exterior through the holes 113, as shown by the arrows (3). In other words, heat is not confined, but the radiant heat cannot be blocked.

Figure 11C:
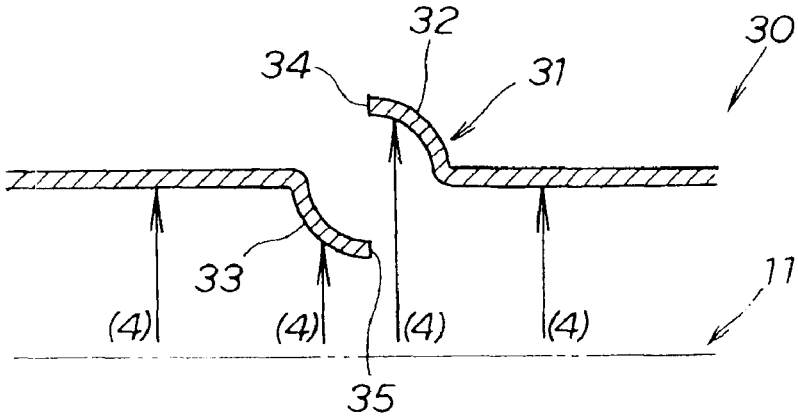
Figure 11D:
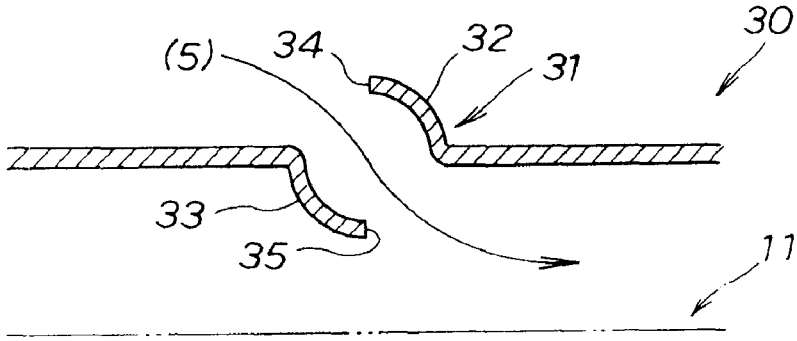

In FIG. 11C, when the exhaust component cover 30 according to the third embodiment is used, radiant heat can be blocked by the exhaust component cover 30 as shown by the arrows (4), cooling air can be taken into the exhaust component cover 30 from the exterior as shown by the arrow (5) in FIG. 11D, and the exhaust component 11 can be cooled.

In other words, radiant heat shown by arrows (4) extending directly toward the exterior comes up against and is blocked by the exhaust component cover 30 as shown in FIGS. 11C and 11D. Communicating the inside of the exhaust component cover 30 with the outside through the louvers 31 allows a convection current to be created from the exterior of the exhaust component cover 30 to the interior. Heat can be radiated to the exterior by this convection current, and the temperature of the exhaust component 11 can be reduced. Furthermore, the exhaust component cover 30 is also capable of blocking sound that expands directly outward in the same manner as the radiant heat.

Figure 12A:
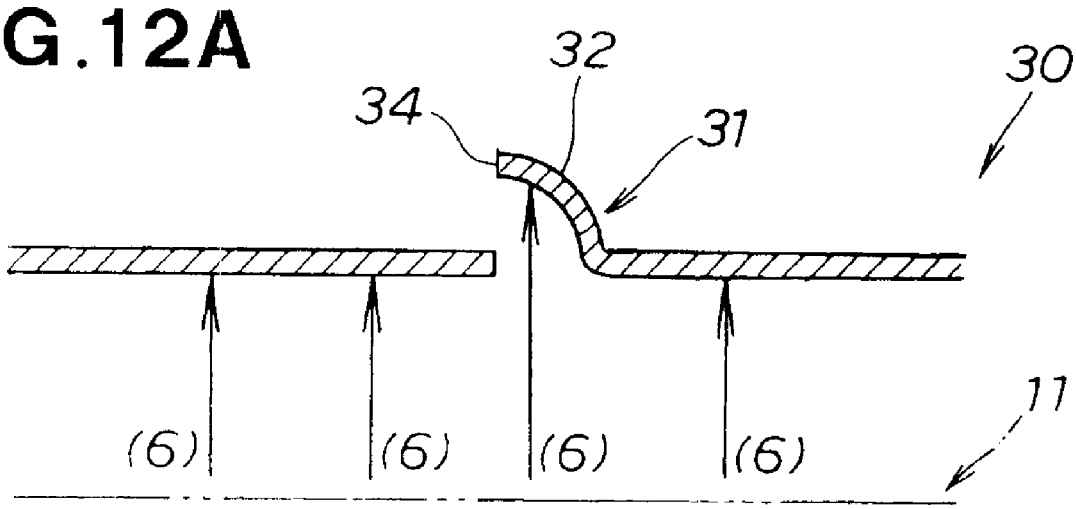
FIGS. 12A and 12B are views showing a modification of the exhaust component cover according to the third embodiment shown in FIGS. 11C and 11D.
Figure 12B:
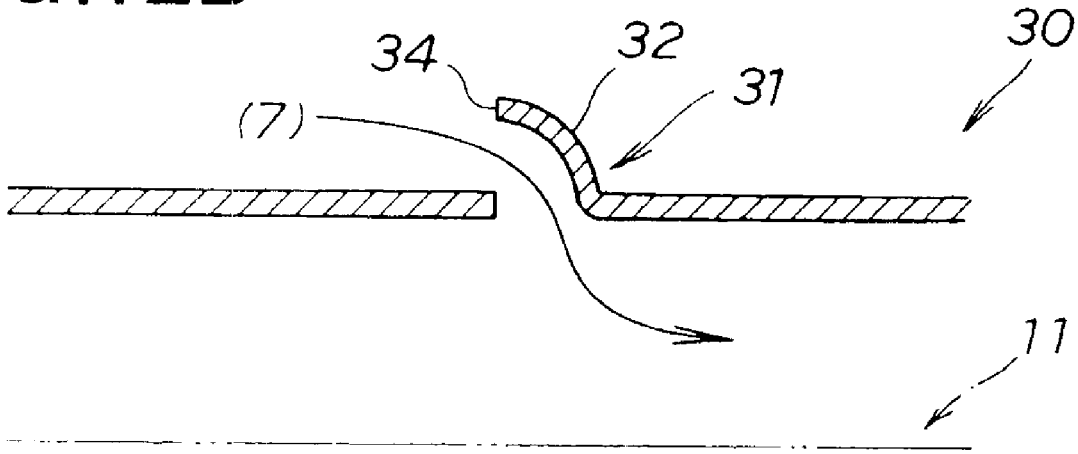

FIGS. 12A and 12B show a modification of the exhaust component cover according to the third embodiment shown in FIGS. 7 through 10. The louvers 31 in this modification are composed only of top convex parts 32.

In FIG. 12A, the exhaust component cover 30 according to the modification blocks radiant heat as shown by the arrows (6), and the exhaust component 11 can be cooled by cooling air being taken in from the exterior as shown in FIG. 12B.

Figure 13:
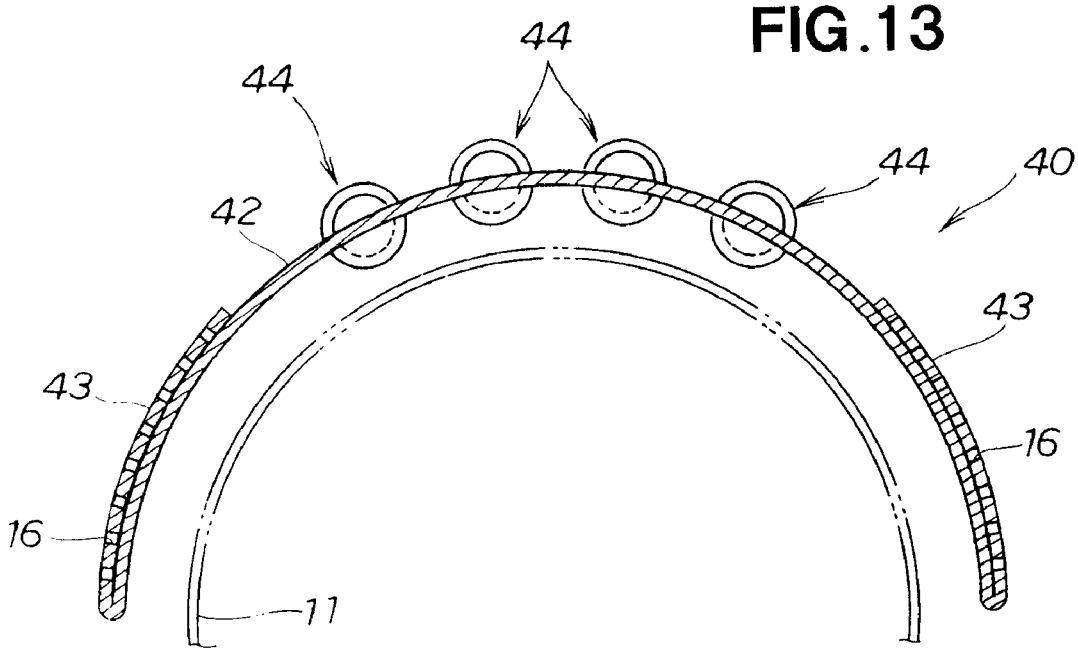
FIG. 13 is a cross-sectional view showing an exhaust component cover according to a fourth embodiment of the present invention.
Figure 14:
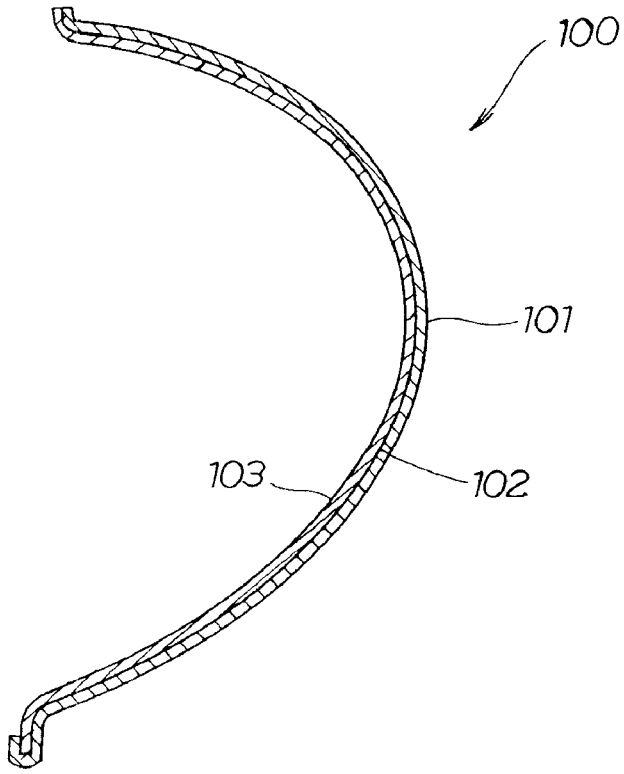
FIG. 14 is a cross-sectional view showing a conventional exhaust component cover.

Reference is now made to FIG. 13 showing an exhaust component cover 40 according to a fourth embodiment of the present invention. Opposite ends of an internal plate 42 is bent outwardly to thereby provide an external plate 43. Then, the external plate 43 press-formed into an arc shaped in cross section to thereby provide the exhaust component cover 40. The internal plate 42 has a flush internal peripheral surface, like the arrangement according to the second embodiment shown in FIG. 2. The external plate 43 has a plurality of punched holes.

The exhaust component cover 40 according to the fourth embodiment of the present invention has a plurality of louvers 44 constructed similarly to the louvers formed in the external plate of the exhaust component cover according to the third embodiment discussed in relation to FIG. 8.

Namely, the internal plate 42 has the louvers 44 that allow air to flow from outside the internal plate into inside the latter. The exhaust component 11 is thus placed in air communication with outside through the louvers 44. Each louver 44 has a circular shape formed by upper (top) and lower (bottom) semicircular portions separated by the internal plate 42, like the louver according to the third embodiment discussed in relation to FIGS. 9 and 10.

Upper semicircular portion comprises a convex part protruding upwardly while the lower semicircular portion comprises a concave part recessed downwardly. The convex part is a one fourth of a spherical shell extending outwardly (upwardly) of the internal plate 42. The concave part is a one fourth of a spherical shell extending internally (downwardly) of the internal plate 42 toward the exhaust component 11.

The exhaust component cover 40 according to the fourth embodiment operates similarly to the exhaust component cover 30 according to the third embodiment and produces results similar to those produced by the latter.

Obviously, various minor changes and modifications of the present invention are possible in light of the above teaching. It is therefore to be understood that within the scope of the appended claims the invention may be practiced otherwise than as specifically described.

What is claimed is:

1. An exhaust component cover comprising: an internal plate designed to cover an exhaust component; and an external plate formed by bending part of the internal plate, the external plate being joined to an outside surface of the internal plate, wherein the internal plate and the external plate are formed from a single sheet, wherein the external plate includes a plurality of punched holes formed therein, and wherein the internal plate has a plurality of louvers formed to allow air to flow from outside of the internal plate to inside of the latter, each of the louvers having a semicircular shape when the exhaust component cover is viewed from the outside, the semicircles each being one fourth of a spherical shell extending outwardly from the exhaust component cover.

2. The exhaust component cover of claim 1, wherein the louvers block radiant heat from an exhaust component.

3. The exhaust component cover of claim 1, wherein the exhaust component cover covers an exhaust component and the louvers block radiant heat from the exhaust component.

4. The exhaust component cover of claim 1, wherein the louvers providing air convection currents from the outside of the exhaust component cover to a space between the exhaust component cover and the exhaust component, and the air convection currents reducing a temperature of the exhaust component cover.

5. The exhaust component cover of claim 1, wherein the louvers introducing cooling air from the outside of the exhaust component cover to a space between the exhaust component cover and the exhaust component, thereby reducing a temperature of the exhaust component cover.

6. The exhaust component cover of claim 1, wherein the louvers providing air convection currents from the outside of the exhaust component cover to a space between the exhaust component cover and the exhaust component, the louvers blocking radiant heat from the exhaust component, and the air convection currents reducing a temperature of the exhaust component cover.

7. The exhaust component cover of claim 1, wherein the louvers introducing cooling air from the outside of the exhaust component cover to a space between the exhaust component cover and the exhaust component, thereby reducing a temperature of the exhaust component cover, and the louvers blocking radiant heat from the exhaust component.

8. An exhaust component cover, comprising: first and second plates joined together to provide a two-ply construction for covering an exhaust component, wherein the first and second plates are formed from a single sheet, wherein at least one of the first and second plates have a plurality of punched holes formed therein, and the other of the at least one of the first and second plates have a plurality of louvers having a semicircular shape when the exhaust component cover is viewed from the outside, the semicircles each being one fourth of a spherical shell extending outwardly from the exhaust component cover, the louvers providing air convection currents from the outside of the exhaust component cover to a space between the exhaust component cover and an exhaust component, and the air convection currents reducing a temperature of the exhaust component cover.

9. The exhaust component cover of claim 8, wherein the louvers block radiant heat from an exhaust component.

10. The exhaust component cover of claim 8, wherein the exhaust component cover covers an exhaust component and the louvers block radiant heat from the exhaust component.

11. The exhaust component cover of claim 8, wherein the louvers introduce cooling air from the outside of the exhaust component cover to a space between the exhaust component cover and the exhaust component, thereby reducing a temperature of the exhaust component cover.

* * * * *